US007185470B1

(12) United States Patent
Link

(10) Patent No.: US 7,185,470 B1
(45) Date of Patent: Mar. 6, 2007

(54) RETAINING WALL BLOCK

(75) Inventor: James Barry Link, Abingdon, VA (US)

(73) Assignee: E. Dillon & Company, Swords Creek, VA (US)

( * ) Notice: Subject to any disclaimer, the term of this patent is extended or adjusted under 35 U.S.C. 154(b) by 526 days.

(21) Appl. No.: 10/814,893

(22) Filed: Mar. 31, 2004

(51) Int. Cl.
*E04C 1/00* (2006.01)

(52) U.S. Cl. ..... 52/605; 52/603; 52/604; 52/606; 52/608; 405/284; 405/286; 405/287

(58) Field of Classification Search ..... 52/596–600, 52/603–612; 405/273, 284–287
See application file for complete search history.

(56) References Cited

U.S. PATENT DOCUMENTS

| | | | | |
|---|---|---|---|---|
| 2,313,363 | A * | 3/1943 | Schmitt | 405/286 |
| 4,040,225 | A * | 8/1977 | Bretone | 52/585.1 |
| 4,909,010 | A | 3/1990 | Gravier | |
| 4,914,876 | A * | 4/1990 | Forsberg | 405/286 |
| 5,161,918 | A | 11/1992 | Hodel | |
| 5,294,216 | A | 3/1994 | Sievert | |
| 5,484,236 | A | 1/1996 | Gravier | |
| 5,505,034 | A | 4/1996 | Dueck | |
| 5,704,183 | A * | 1/1998 | Woolford | 52/604 |
| 5,707,183 | A * | 1/1998 | Akamine | 405/284 |
| 5,711,129 | A * | 1/1998 | Woolford | 52/604 |
| D411,315 | S | 6/1999 | Bott | |
| 6,287,054 | B1 * | 9/2001 | Egan et al. | 405/262 |
| 6,523,317 | B1 * | 2/2003 | Bott et al. | 52/609 |
| 6,651,401 | B2 * | 11/2003 | Price et al. | 52/604 |
| 6,715,965 | B2 * | 4/2004 | Manthei et al. | 405/284 |
| 6,829,867 | B2 * | 12/2004 | Gresser et al. | 52/603 |

* cited by examiner

*Primary Examiner*—Jeanette E. Chapman

(57) ABSTRACT

A block for use in constructing a retaining wall and comprising a body having a central cavity extending vertically there through and defining front, rear, and side walls. The side walls diverge rearwardly from the front of the block to the rear. Stabilizing wings extending outwardly at the rear of the side walls. Positioning wedges extend from the bottom surface and include flat forward surfaces for positioning the block with respect to the blocks in a lower tier of blocks. The flat forward surfaces of the positioning wedges are located nearer the front surface of the block than is the inner surface of the front wall, thereby enabling a retaining wall created from the blocks to have each successive higher tier offset from the adjacent lower tier by a set distance. The block of the present invention provides a stable block having a large coverage area at a low weight.

18 Claims, 8 Drawing Sheets

RETAINING WALL BLOCK

FIELD OF THE INVENTION

The present invention relates to blocks used to form retaining walls and more particularly to a retaining wall block with a high coverage to weight ratio and positioning wedges and channels for rapid positioning of an upper block upon a lower tier of blocks in a retaining wall formed from said blocks.

BACKGROUND OF THE INVENTION

Retaining walls are used to constrain earth embankments from sliding or falling and are commonly constructed from retaining wall blocks. The blocks typically have an interconnecting feature and are commonly stacked in tiers to the desired height to form the retaining wall. The tiers of blocks are often offset with respect to one another to form a retaining wall that is inclined from vertical with each successive upper tier stepped away from the adjacent lower tier.

Various blocks have been proposed for constructing retaining walls. One block is that shown in U.S. Pat. No. 5,161,918 to Hodel (hereinafter the '918 patent), which discloses a block having a hole and pin arrangement for interlocking adjacent tiers of blocks in a set-back relation. The pins are rotatably adjustable to interlock the tiers in a straight configuration or in varying degrees of convex and concave configurations.

Another retaining wall block is that disclosed in U.S. Pat. No. 4,909,010 to Gravier (hereinafter the '010 patent), which discloses a block with a stepped top surface. The stepped top surface provides an interlock area to receive additional blocks thereon to create a retaining wall.

U.S. Pat. No. 5,505,034 to Dueck (hereinafter the '034 patent) discloses a block for forming a retaining wall that includes an internal cavity and protruding knobs having a rounded surface. The rounded knobs are positioned for protruding into the internal cavity of at least one other block in a wall formed from the blocks and are adapted to abut the internal walls of the open cavity to position the block in the retaining wall.

Although the aforementioned patents disclose blocks having features useful for forming a retaining wall, they are not optimal. The hole and pin arrangement of the '918 patent requires the manufacture of pins separate of the blocks which adds to the cost of the retaining wall. Additionally, for each block fitted into the wall, the pins must be set in place and rotated to the correct orientation to create the desired wall configuration.

The interlocking system of the '010 patent, as a result of the outer front edges of an upper block contacting the interlocking step in the top surface of a lower row of blocks, is better suited to the construction of straight retaining walls. When used to construct a curved retaining wall the blocks of the '010 patent contact the lower tier of blocks on their outer bottom edges, which causes a large gap to form between the lower front edge of the block in an upper tier of blocks and the front lip of the blocks in the lower tier. This gap will widen and become excessive as the curved retaining wall is built higher, as the radius of curvature decreases with each successive layer. The '010 patent does mention that the block can be modified to form curved surfaces, but only shows a dotted line configuration and no embodiments are shown in the figures except for the dotted line suggestion.

Forming a curved wall with the single cavity block of the '034 patent requires the installer to break off two frangible extensions, which being a part of the original block detracts from the coverage to weight ratio of the block. A disadvantage of the single cavity block of the '034 patent is that the frangible extensions extend to a line perpendicular to the front face of the bloc, requiring the installer to break off the two frangible extensions when forming a curved wall. Including the frangible extensions decreases the coverage to weight ratio for a portion that eventually will be removed and discarded in the construction of a curved retaining wall, adding to wastage of material. Additionally, the top surface of a block according to the '034 patent is flat, therefore not allowing a block placed on top of a lower tier to be slid between adjacent cavities without first lifting the block to elevate the projecting means above the side walls of the blocks in the lower tier.

The retaining wall block of the present invention includes sharply diverging side walls and wings that extent substantially less than a plane tangent to the front corner and perpendicular to the front face of the block. This block geometry enables construction of either a straight or curved retaining wall without requiring any portion of the blocks to be broken away, thereby decreasing wastage and increasing the coverage to weight ratio of the blocks. The block of the present invention also includes channels formed in the top surface of the blocks, thereby allowing a block in a straight wall to be repositioned without requiring it to be lifted to clear the side walls of the blocks in the lower tier.

The block of the present invention therefore simplifies construction of a retaining wall by decreasing the weight of the block for a given coverage area and by virtue of the channels in the top surface making it easier for the block to be repositioned.

These, and other advantages will be apparent to a person skilled in the art by reading the attached description along with reference to the attached drawings.

SUMMARY OF THE INVENTION

According to the present invention, a block is provided for use in constructing a retaining wall. The block comprises a body having a central cavity extending vertically there through and defining front, rear, and side walls. The side walls diverge rearwardly from the front of the block to the rear. Stabilizing wings extending outwardly at the rear of the side walls. Positioning wedges extend from the bottom surface and include flat forward surfaces for positioning the block with respect to the blocks in a lower tier of blocks. The flat forward surfaces of the positioning wedges are located nearer the front surface of the block than is the inner surface of the front wall, thereby enabling a retaining wall created from the blocks to have each successive higher tier offset from the adjacent lower tier by a set distance. The block of the present invention provides a stable block having a large coverage area at a low weight.

TABLE OF NOMENCLATURE

Figure 1:
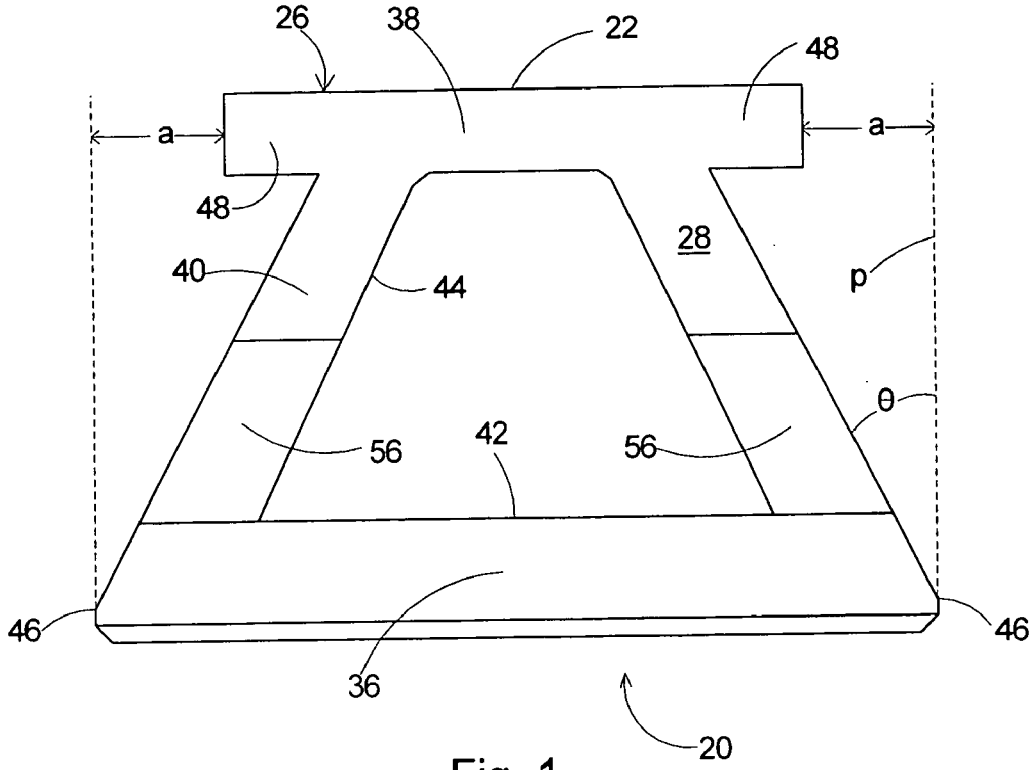
FIG. 1 is a bottom view of a preferred embodiment of a retaining wall block according to the present invention.

The following is a listing of part numbers used in the drawings along with a brief description:

| Part Number | Description |
|---|---|
| 20 | retaining wall block |
| 22 | body |
| 24 | front surface |
| 26 | rear surface |
| 28 | bottom surface |
| 30 | top surface |
| 32 | side surface |
| 34 | central cavity |
| 36 | front wall |
| 38 | rear wall |
| 40 | side wall |
| 42 | front inner wall surface |
| 44 | side inner wall surface |
| 46 | front corner |
| 48 | stabilizing wing |
| 49 | rear surface of stabilizing wing |
| 50 | plane tangent to front corner and perpendicular to front face |
| 52 | positioning wedge |
| 54 | flat forward surface of positioning wedge |
| 56 | channel |
| 58 | vertical portion of front surface |
| 60 | beveled portion of front surface |
| 62 | flat forward edge of channel |
| 64 | interior side wall portion of positioning wedge |
| 66 | exterior side wall portion of positioning wedge |
| 68 | straight retaining wall |
| 70 | lower tier of blocks |
| 72 | upper tier of blocks |
| 73 | granular drainage rock |
| 74 | drainage pipe |
| 75 | forward wall face |
| 76 | block in lower tier |
| 78 | block in upper tier |
| 80 | rearward extent of channel |
| 82 | forward extent of channel |
| 84 | curved retaining wall |

DETAILED DESCRIPTION

Referring to FIGS. 1–4 there are depicted three views of a preferred embodiment of a retaining wall block 20 according to the present invention. The retaining wall block 20 includes a body 22 having a front 24, rear 26, bottom 28, top 30, and side 32 surfaces. A central cavity 34 extends vertically through the body 22 thereby defining a front 36, rear 38, and side 40 walls. Each of the walls has an inner surface, including a front inner wall surface 42 and side inner wall surfaces 44.

Figure 4:
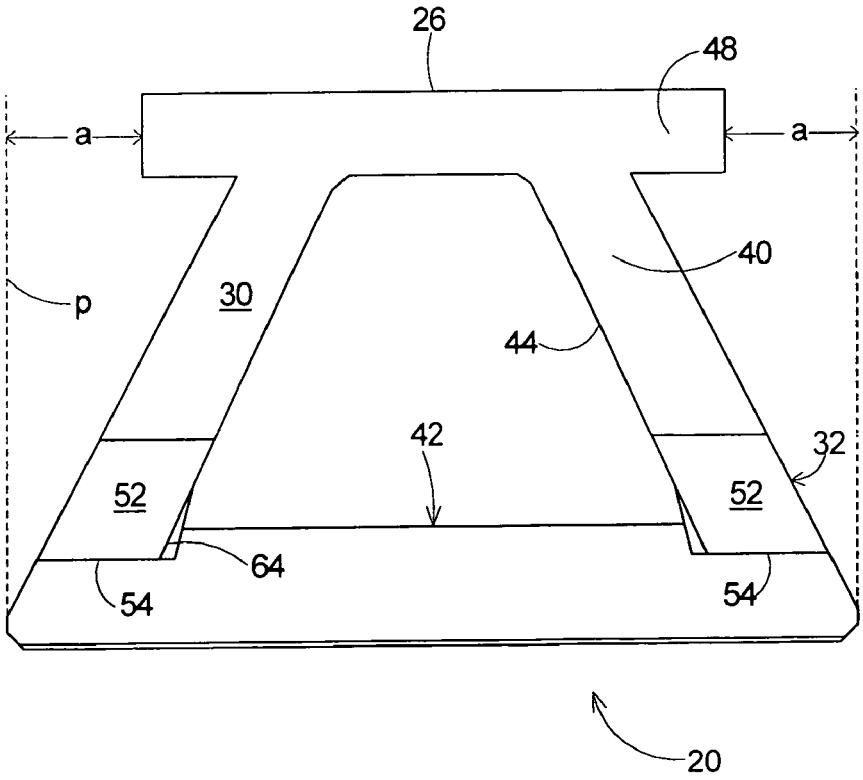
FIG. 4 is a bottom view of the retaining wall block of FIG. 1.

The block 20 includes front corners 46 are located at the intersection of each of the side walls 40 and the front wall 36. As shown in FIGS. 1 and 4, the side walls 40 diverge rearwardly from the front corner 46 of the block 20. A stabilizing wing 48 extends outwardly from each of the side walls 40 adjacent the rear surface 26. The stabilizing wings 48 have rear surfaces 49 coplanar with the rear surface 26 of the block. As denoted by the distance a in FIGS. 1 and 4, each of the wings extends substantially less than the plane 50 tangent to the front corner 46 and perpendicular to the front surface 24. The side walls 40 diverge rearwardly from the front surface 24 preferably at an angle of 20 degrees or greater from the plane perpendicular to the front surface. In a most preferred embodiment, the side walls diverge rearwardly from the front surface at an angle of 27 degrees ($\theta$ in FIG. 1) from perpendicular with the front surface.

Figure 2:
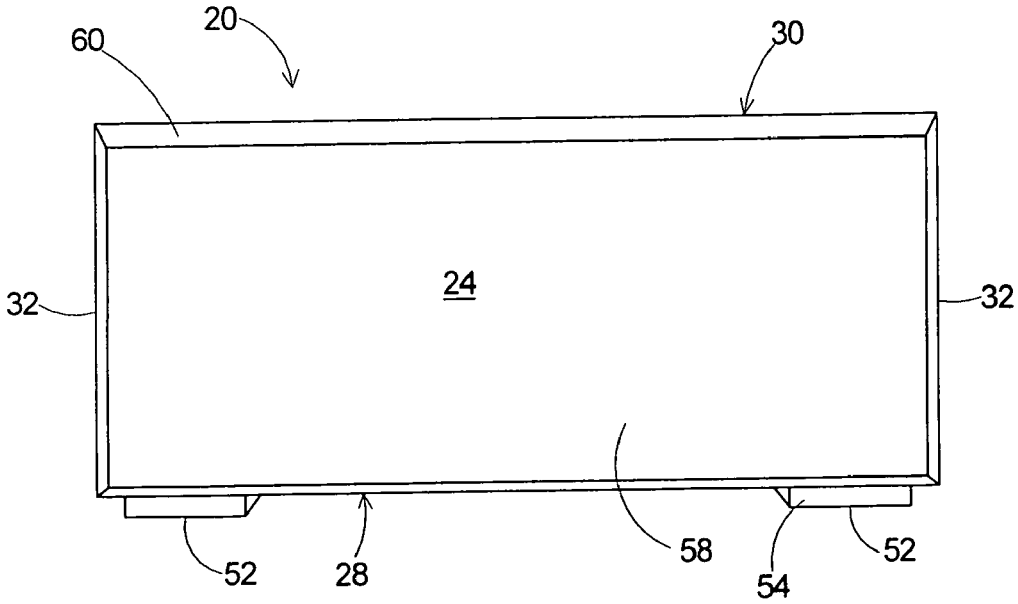
FIG. 2 is a front view of the retaining wall block of FIG. 1.
Figure 3:
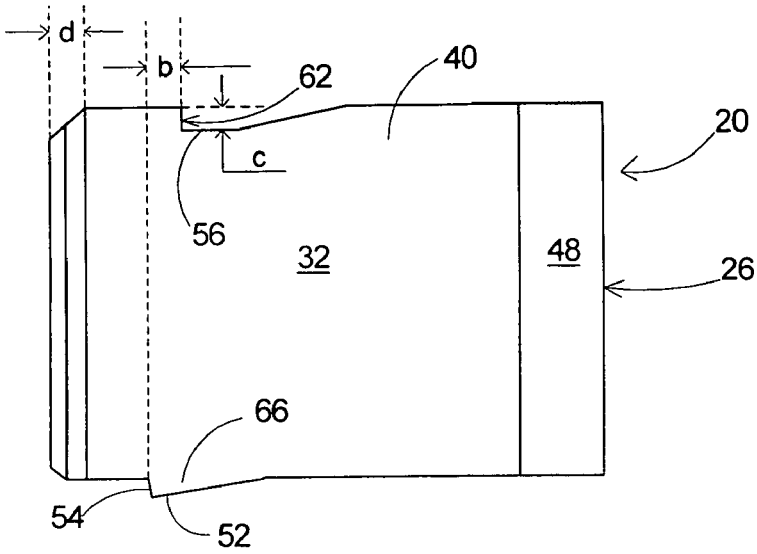
FIG. 3 is a side view of the retaining wall block of FIG. 1.
Figure 5:
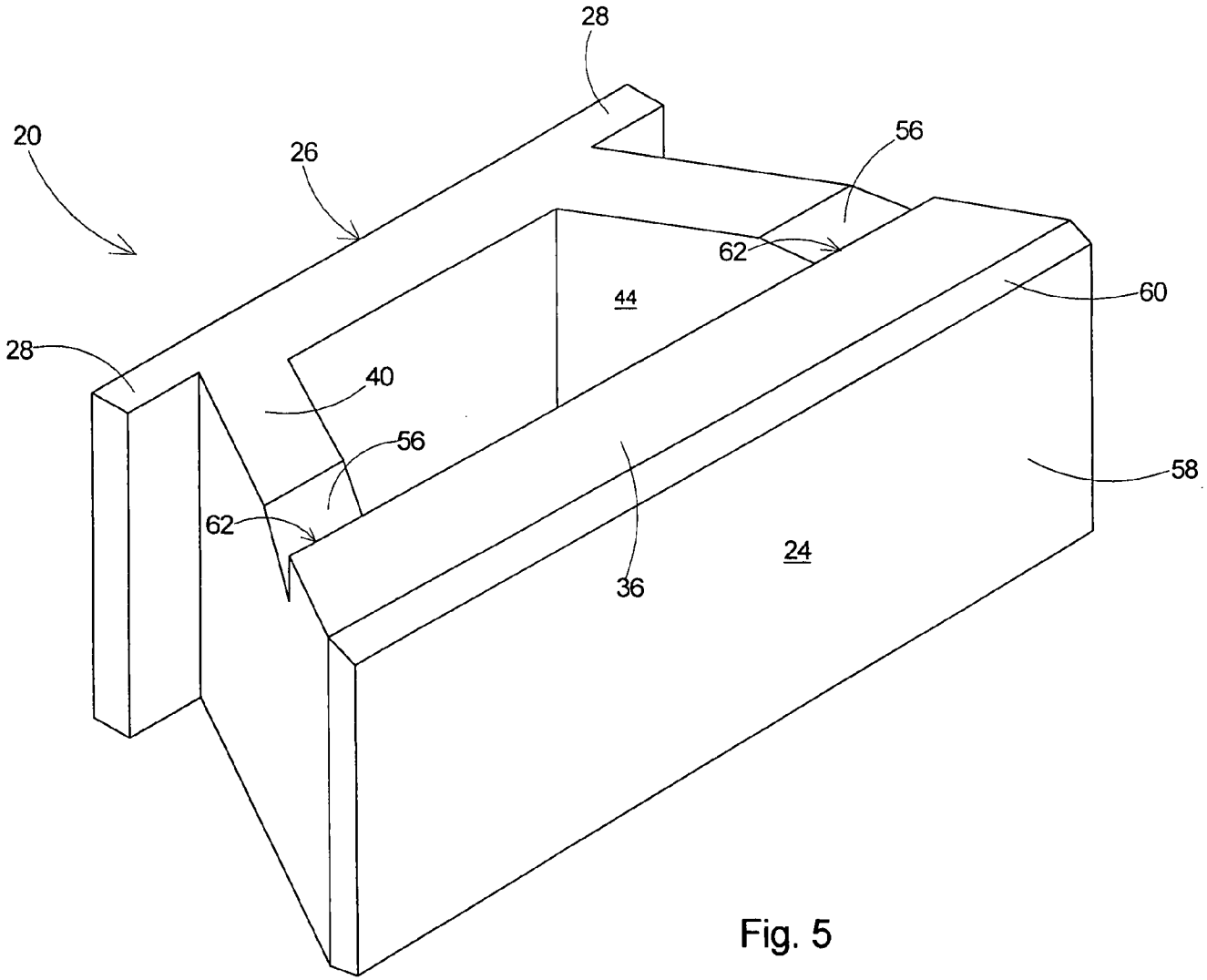
FIG. 5 is a top perspective view of the retaining wall block of FIG. 1.
Figure 6:
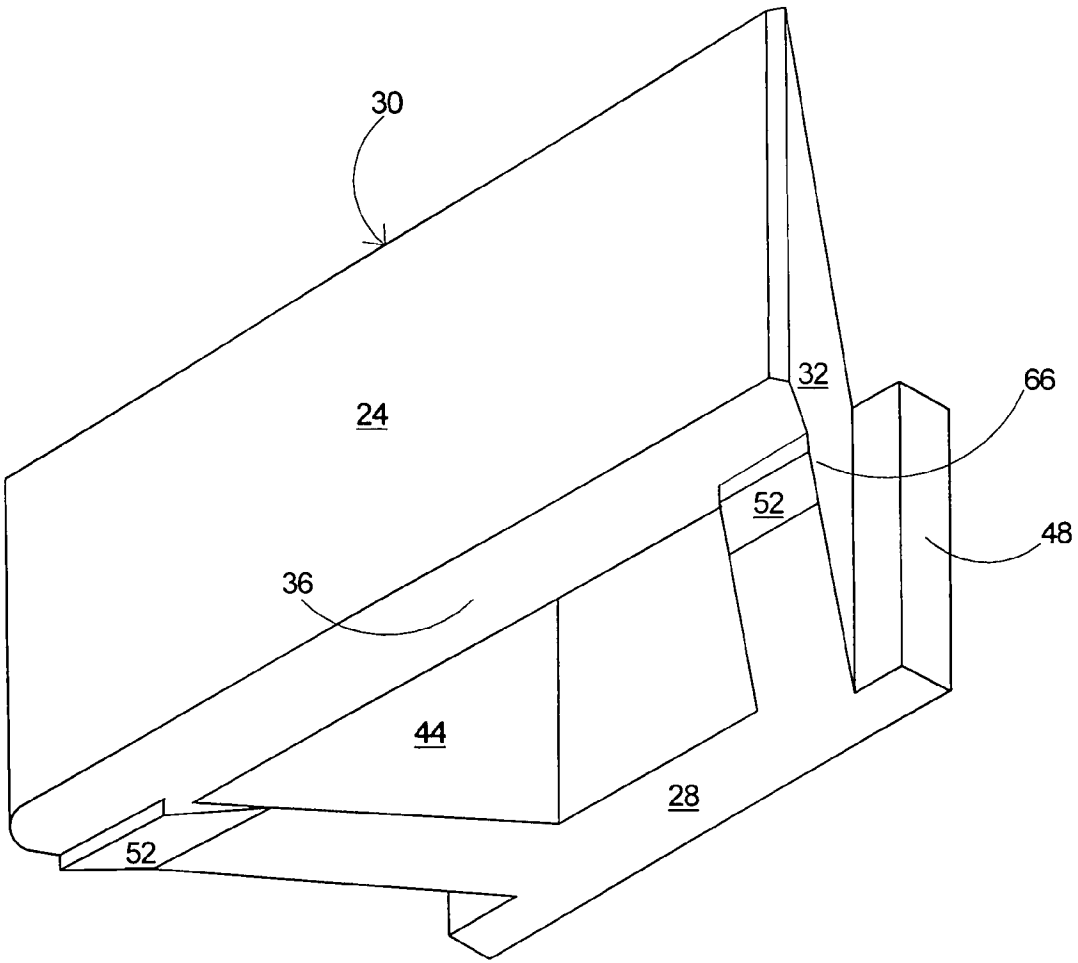
FIG. 6 is a bottom perspective view of the retaining wall block of FIG. 1.

With reference to FIGS. 2–4, two positioning wedges 52 extend from the bottom surface 28 and include flat forward surfaces 54. The flat forward surface 54 of each positioning wedge 52 is located nearer the front surface 24, designated by the distance b in FIG. 3, than is the front inner wall surface 42. The retaining wall block 20 includes channels 56 on the top surface 30 extending a first depth c into each of the side walls 40. The front surface 24 of the retaining wall block 20 includes a vertical portion 58 extending from the bottom surface 28 and a beveled portion 60 extending from the vertical portion 58 to the top surface 30. With reference to FIG. 3, the beveled portion 60 extends laterally to the vertical portion 58 by a second distance d, which is preferably equal to the distance b. Referring to FIGS. 3 and 5, the channels 56 in the top surface 30 include flat forward edges 62 that are coplanar with the front inner wall surface 42. The flat forward surface 54 of the positioning wedges 52 are positioned nearer the front surface 24 of the block 20 than the flat forward edge 62 of the channel 56 and the front inner wall surface 42.

With reference to FIGS. 2–4 and 6, the positioning wedges 52 extend laterally from the side inner wall surface 44 of the block 20 to the side surface 32 of the block. The positioning wedges 52 include an interior side wall portion 64 that is coplanar with the side inner wall surface 44 and an exterior side wall portion 66 coplanar with the side surface 32. As shown in FIG. 4, the positioning wedges 52 are substantially rectangular shaped.

Figure 8:
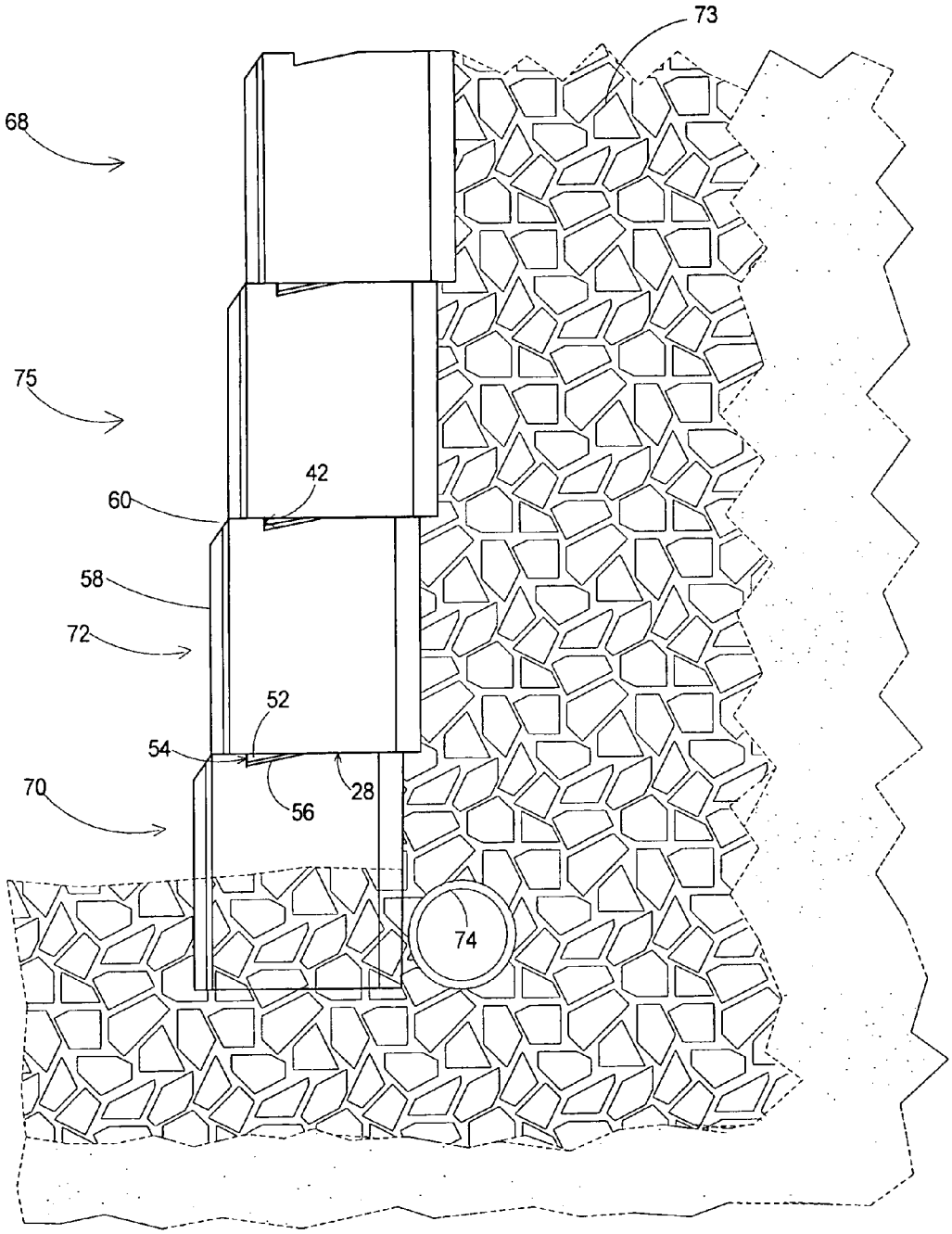
FIG. 8 is a side conceptual view of a retaining wall constructed with retaining wall blocks according to the present invention.

The retaining wall block of the present invention can be used to construct a retaining wall such as the straight retaining wall 68 shown in FIG. 8. Although a retaining wall with four tiers are shown, principles of construction of the wall will be explained by reference to two of the tiers 70, 72. As a result of the flat forward surface 54 of the positioning wedges 52 being positioned nearer the front surface 24 of the block 20 than the flat forward edge 62 of the channel 56 and the front inner wall surface 42, construction of a retaining wall by stacking blocks in tiers, such as the lower tier 70 and upper tier 72 shown in FIG. 8, positions the front surface 24 in an upper tier 72 of blocks the distance b (shown in FIG. 3) behind the front surface of the lower tier 70 of blocks. Prior to forming the retaining wall 68, granular drainage rock 73 is used to form a bed under the retaining wall 68 and usually is used to cover half of the lower tier 70 as shown. To facilitate rapid drainage of water, a drainage pipe 74 is typically positioned behind the retaining wall 68 as shown and covered with granular drainage rock 73.

Figure 7:
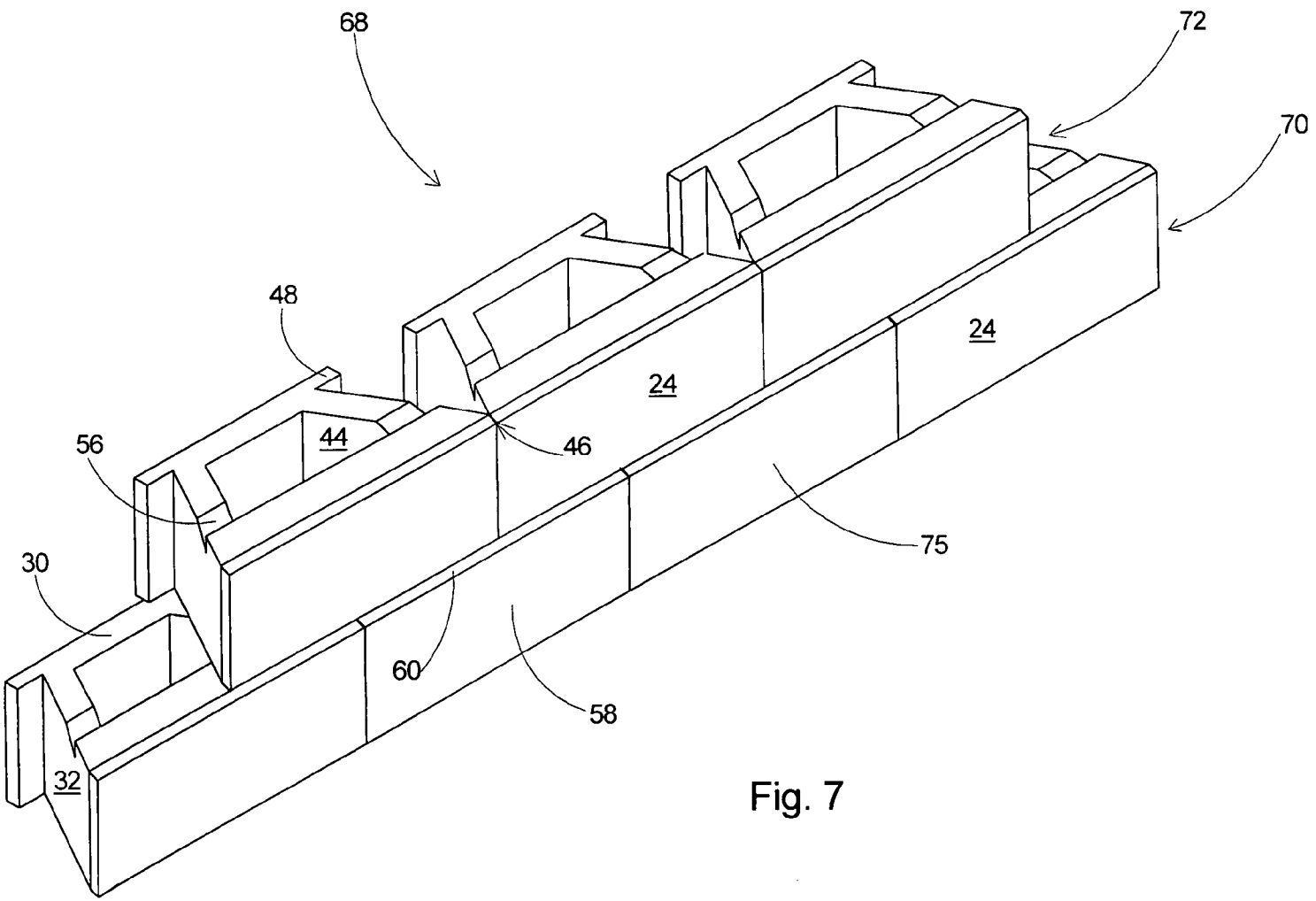
FIG. 7 is a perspective view of a straight retaining wall constructed with retaining wall blocks according to the present invention.

With reference to FIGS. 7 and 8, the retaining wall 68 is constructed by stacking blocks 20 in successive tiers. A plurality of blocks 20 are formed into the retaining wall 68 by placing a lower tier 70 of blocks with the blocks 20 in the lower tier 70 in contact at the front corners 46. An upper tier 72 of blocks is then formed by placing the flat forward surfaces 54 of the positioning wedges 52 of the blocks of the upper tier 72 in engagement with the front inner wall surface 42 of one or more of the blocks in the lower tier 70. The blocks in the upper tier 72 are positioned by placing blocks 20 upon the lower tier 70 and sliding them forward until the flat forward surface 54 of the positioning wedges 52 contact the front inner wall surface 42 of one or more blocks 20 in the lower tier 70 of blocks. The blocks 20 are dimensioned such that the channels 56 extending the first depth c (see FIG. 3) into each of the side walls 40 on the top surface 30 of the blocks 20 in the lower tier 70 accommodate the positioning wedges 52 extending from the bottom surface 28 of the blocks 20 in the upper tier 72. A straight retaining wall 68 constructed with the retaining wall blocks 20 according to the present invention therefore presents a retaining wall with a forward wall face 75 that includes a series of vertical 58 and beveled 60 surfaces.

Figure 9:
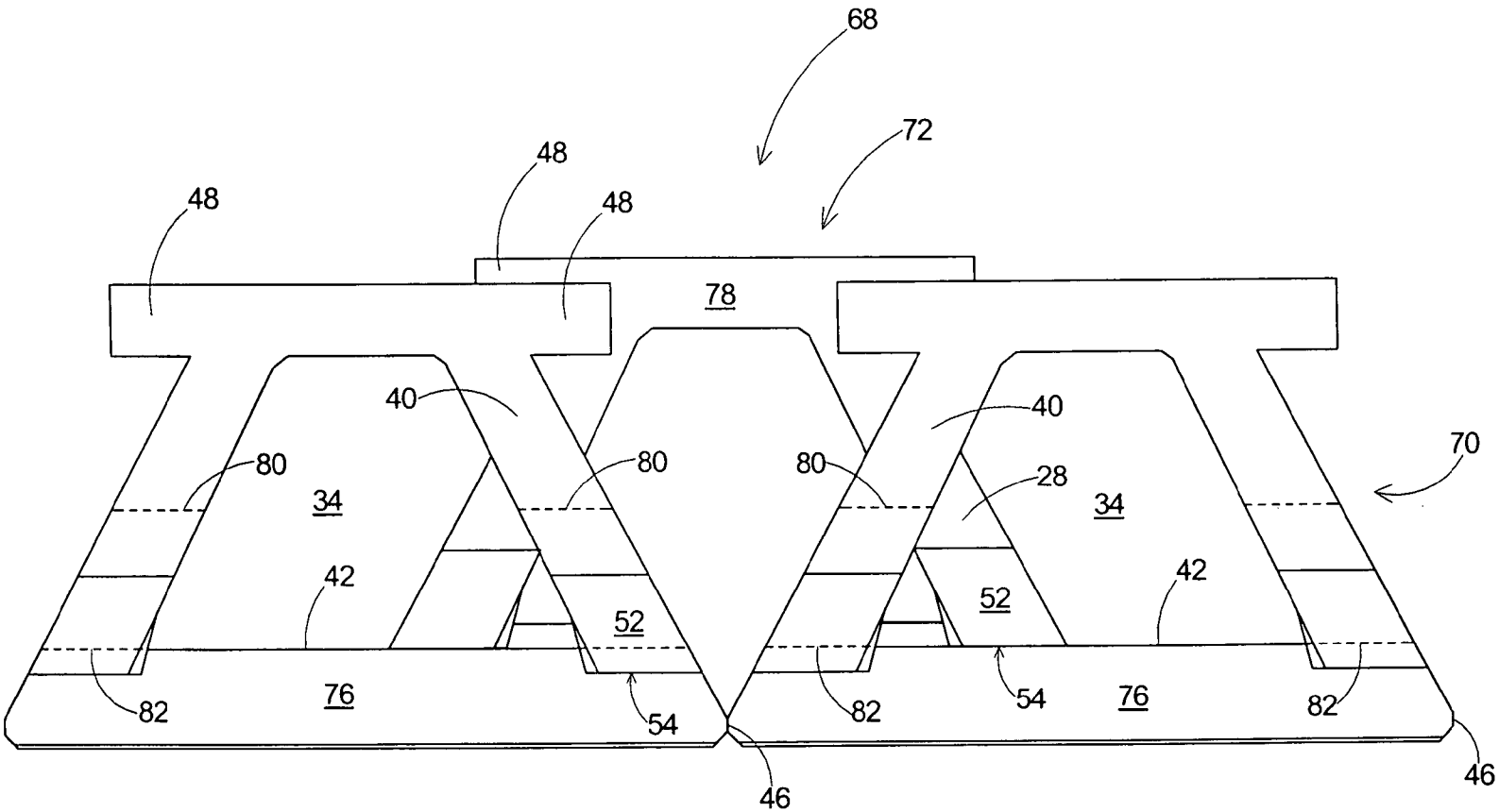
FIG. 9 is a bottom view of a portion of a straight retaining wall depicting two blocks in a lower tier overlaid by a single block in an upper tier.

Referring to FIG. 9, a bottom view is shown of a portion of a straight retaining wall 68 depicting two blocks 76 in a lower tier 70 overlaid by a single block 78 in an upper tier 72. To form the straight retaining wall 68, the blocks 76 are arranged end to end in a straight row with the front corners 46 in contact to form the lower tier 70. A block 78 is then placed on top of the lower tier 70 with the positioning wedges 52 placed in the central cavities 34 of the blocks 76 in the lower tier 70. The upper block 78 is then centered over the two lower blocks 76. The rearward extent 80 of the channels 56 on the opposite side of the lower blocks 76 is shown by the broken lines on the side walls 40. It should be apparent that one advantage of the present retaining wall block is that the channels 56 allow the upper block 78 to be slid laterally across the lower blocks 76 to reposition the upper block 78 as desired. In case an upper block 78 must be moved across several lower blocks 76, the channels 56 in the top surface of the lower blocks 76 provide openings to allow passage of the positioning wedges 52 there through. This feature makes it easy to reposition blocks during construction of the wall as desired. The channels in the top surface of a lower tier 70 of blocks in the straight retaining wall 68, whose rearward 80 and forward 82 extents are indicated by the broken lines, therefore provide openings for passage of the positioning wedges 52 in the bottom surface 28 of an upper tier 72 of blocks when a block 78 of the upper tier 72 of blocks is slidingly moved with respect to the lower tier 70 of blocks. The stabilizing wings 48 of the upper block 78 rest partially on the stabilizing wings 48 of the lower blocks 76, thereby stabilizing the retaining wall.

Figure 10:
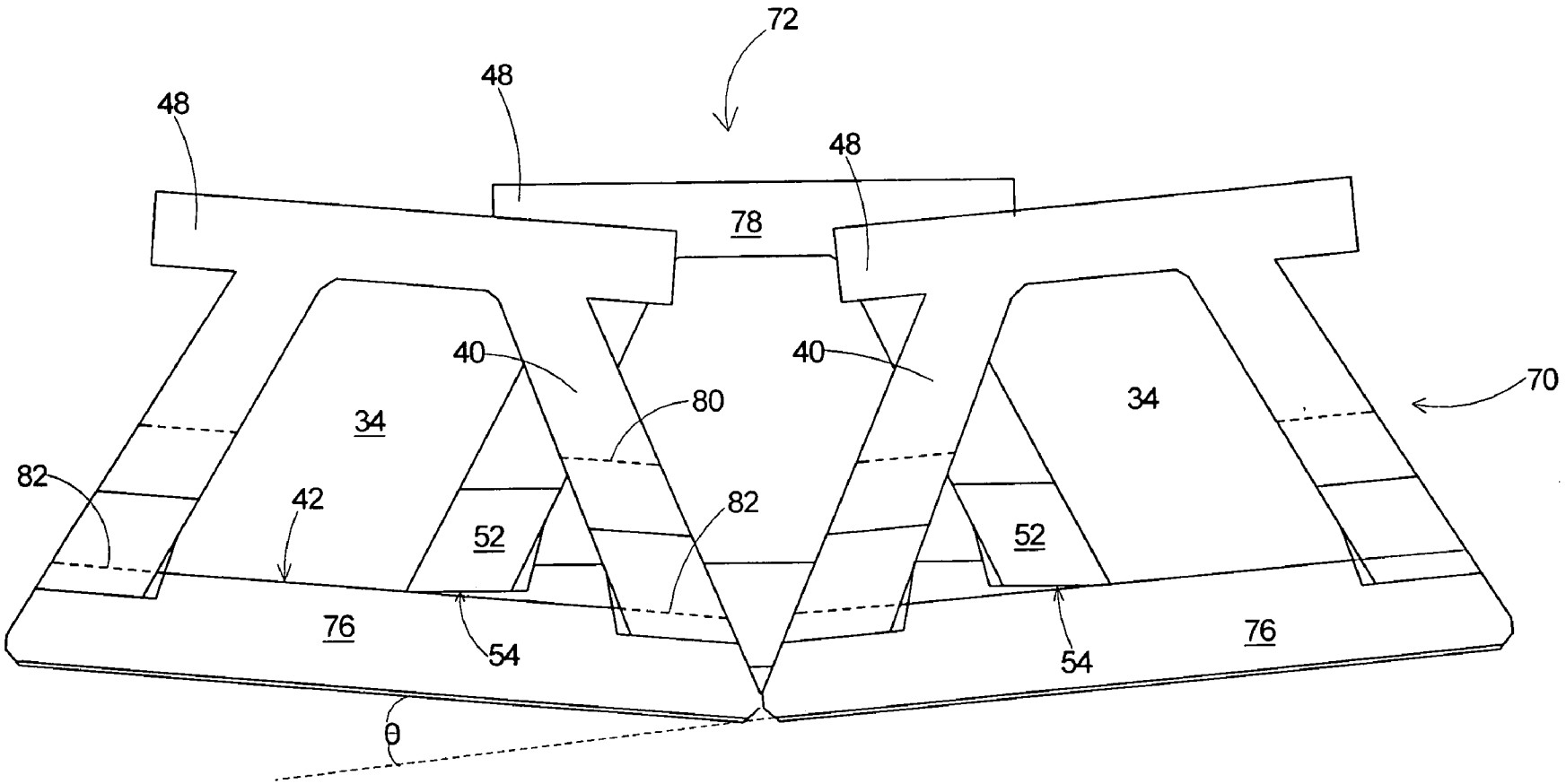
FIG. 10 is a bottom view of a portion of a curved retaining wall depicting two blocks in a lower tier overlaid by a single block in an upper tier.

Referring to FIG. 10, a bottom view is shown of a portion of a curved retaining wall 84 depicting two blocks 76 in a lower tier 70 overlaid by a single block 78 in an upper tier 72. To form the curved retaining wall 84, the blocks 76 are arranged with the front corners 46 in contact and at the desired angle θ to form the lower tier 70. A block 78 is then placed on top of the lower tier 70 with the positioning wedges 52 placed in the central cavities 34 of the blocks 76 in the lower tier 70. The upper block 78 is then centered over the two lower blocks 76. The stabilizing wings 48 of the upper block 78 rest partially on the stabilizing wings 48 of the lower blocks 76, thereby stabilizing the curved retaining wall 84.

Referring to FIGS. 3 and 8, the flat forward surface 54 of each positioning wedge 52 is located nearer the front surface 24, designated by the distance b in FIG. 3, than is the front inner wall surface 42. Therefore stacking blocks in tiers vertically, with the flat forward surface 54 of the positioning wedges 52 of an upper block in engagement against the front inner wall surface 42 of a lower block, creates a retaining wall with a setback equal to the distance b. In a most preferred embodiment of the retaining wall block of the present invention, the face dimensions of the block are preferably 8 inches tall by 18 inches long (see FIG. 2). The depth of the block 20, or the distance across the block from the front 24 to the rear 26 surface, is preferably 11.8 inches. A most preferred dimension for the distance between the flat forward edge 62 of the channel 56 and the flat forward surface 54 of the positioning wedge 52 is 0.75 inch, thereby creating a setback distance of 0.75 inch between successive tiers of blocks. With a setback distance of 0.75 inch, the retaining wall 68 of FIG. 8 would have a 6 degree setback, which would be the angle from vertical if a straightedge were placed vertically along the face of the retaining wall in FIG. 8. A block 20 according to the preferred embodiment of this invention, would typically have a nominal weight of 63 pounds. Thus, with a face dimension of 8 inches tall by 18 inches long, the preferred embodiment of a retaining wall block according to the present invention would provide a coverage of 144 square inches per block at a weight of 63 pounds, or a coverage to weight ration of 2.29 square inches per pound of block. The high coverage to weight ratio provides a low cost block per area of coverage and is easier to install and lift as a result of its lower weight per unit.

As the invention has been described, it will be apparent to those skilled in the art that the same may be varied in many ways without departing from the spirit and scope of the invention. Any and all such modifications are intended to be included within the scope of the appended claims.

What is claimed is:

1. A retaining wall block comprising:

a body having a front, rear, bottom, top, and side surfaces;

a central cavity extending vertically through said body and defining front, rear, and side walls, said walls having inner surfaces;

a front corner at the intersection of each of said side walls and said front wall;

said side walls diverging rearwardly from said front corner of said block;

a stabilizing wing extending outwardly from each of said side walls adjacent said rear surface;

each of said wings extending substantially less than a plane tangent to said front corner and perpendicular to said front surface;

two positioning wedges extending from said bottom surface, said positioning wedges including flat forward surfaces; and said flat forward surface of said positioning wedge being located nearer said front surface than is said inner surface of said front wall;

whereby a plurality of said blocks are formed into a retaining wall by placing a lower tier of blocks with said blocks in said lower tier in contact at said front corners and forming an upper tier of blocks by placing said flat forward surfaces of said positioning wedges of said blocks of said upper tier in engagement with said inner surface of said front wall of one or more of said blocks in said lower tier.

2. The retaining wall block of claim 1 wherein said positioning wedges extend laterally from said side interior wall of said block to said side surface of said block.

3. The retaining wall block of claim 2 wherein said positioning wedges include an interior side wall portion coplanar with said inner surface of said side wall of said block and an exterior side wall portion coplanar with said side surface of said block.

4. The retaining wall block of claim 3 wherein said positioning wedges are substantially rectangular shaped.

5. The retaining wall block of claim 1 which includes channels on said top surface extending a first depth into each of said side walls.

6. The retaining wall block of claim 5 wherein said channels include flat forward edges coplanar with said front inner wall surface.

7. The retaining wall block of claim 6 wherein said channels extending said first depth accommodate said positioning wedges of said blocks in said upper tier of blocks.

8. The retaining wall block of claim 6 wherein said flat forward surface of said positioning wedges are positioned nearer said front surface of said block than said flat forward edge of said channel and said front interior wall surface thereby positioning said front surface in said upper tier of blocks a first distance behind said front surface of said lower tier of blocks.

9. The retaining wall block of claim 8 wherein said front surface of said block includes a vertical portion extending from said bottom surface and a beveled portion extending from said vertical portion to said top surface.

10. The retaining wall block of claim 9 wherein said beveled portion extends laterally to said vertical portion by a second distance thereby enabling said blocks in said tiers of blocks to present a forward wall face including a series of vertical and beveled surfaces.

11. The retaining wall block of claim 1 wherein said side walls diverge rearwardly from said front surface at an angle of 20 degrees or greater from perpendicular with said front surface.

12. The retaining wall block of claim 1 wherein said side walls diverge rearwardly from said front surface at an angle of 27 degrees from perpendicular with said front surface.

13. The retaining wall block of claim 1 further wherein said wings have rear surfaces coplanar with said rear surface of said block.

14. The retaining wall block of claim 5 wherein said channels of said lower tier of blocks are oriented in such a manner to accept said positioning wedges on said bottom surface of said upper tier of blocks.

15. The retaining wall block of claim 1 wherein said series of blocks in each of said tiers are stacked in a straight line to form a straight retaining wall.

16. The retaining wall block of claim 15 wherein said channels in said top surface of a lower tier of blocks in said straight retaining wall provide openings for passage of said positioning wedges in said bottom surface of an upper tier of blocks when a block of said upper tier of blocks is slidingly moved with respect to said lower tier of blocks.

17. The retaining wall block of claim 8 wherein said first distance is 0.75 inch thereby creating a setback between successive tiers of blocks.

18. The retaining wall block of claim 17 wherein the setback vertically across the face of said retaining wall is 6 degrees.

* * * * *